US005104370A

United States Patent [19]

Yerly et al.

[11] Patent Number: 5,104,370

[45] Date of Patent: Apr. 14, 1992

[54] ANCILLARY DEVICE FOR FASTENING A TOOL WITHIN A PLATEN PRESS

[75] Inventors: Marcel Yerly, Jouxtens; Clément Calore, St. -Prex, both of Switzerland

[73] Assignee: Bobst SA, Switzerland

[21] Appl. No.: 596,031

[22] Filed: Oct. 11, 1990

[30] Foreign Application Priority Data

Oct. 12, 1989 [CH] Switzerland ..... 03709/89

[51] Int. Cl.[5] ..... B31F 1/07; B31F 1/08; B26D 7/26

[52] U.S. Cl. ..... 493/372; 72/481; 83/698; 100/35; 100/918

[58] Field of Search ..... 83/698, 651; 72/481, 72/482; 100/918, 35; 493/372, 396, 467

[56] References Cited

U.S. PATENT DOCUMENTS

| | | | |
|---|---|---|---|
| 3,009,377 | 11/1961 | Laufer et al. | 83/699 |
| 3,167,992 | 2/1965 | Kury | 83/700 |
| 3,570,345 | 3/1971 | Spengler | 83/698 X |
| 4,878,407 | 11/1989 | Harrison et al. | 83/698 X |

FOREIGN PATENT DOCUMENTS

| | | |
|---|---|---|
| 1436873 | 4/1970 | Fed. Rep. of Germany . |
| 1170528 | 1/1959 | France . |
| 372546 | 11/1963 | Switzerland . |
| 523810 | 8/1976 | U.S.S.R. . |

*Primary Examiner*—Frank T. Yost
*Assistant Examiner*—Kenneth Peterson
*Attorney, Agent, or Firm*—Hill, Van Santen, Steadman & Simpson

[57] ABSTRACT

A platen press designed for cutting, creasing or embossing sheet-like materials includes a lower movable beam carrying the sheet, and an upper beam stationary beam or which a tool is fitted. To avoid bending of the tool which has a shape of a plate in an operating position at least one of a chamber of an inner volume of the upper beam is isolated from the atmosphere and is connected to a vacuum source and has a duct extending from the one chamber to a lower surface of the beam adjacent the back surface of the plate forming the tool so as to apply a suction between the tool and the lower surface to hold the tool against the lower surface.

7 Claims, 2 Drawing Sheets

ANCILLARY DEVICE FOR FASTENING A TOOL WITHIN A PLATEN PRESS

BACKGROUND OF THE INVENTION

The present invention is concerned with ancillary process and device for the fastening of a tool with any platen press which tool is designed for cutting, creasing or embossing sheet-like material.

A platen press is used for instance for cutting sheet-like material such as paper or cardboard and uses a tool which consists generally a rectangular large sized plate which on one side is provided with cutting devices. This plate is provided in a rigid frame which surrounds its periphery and secures the plate against a lower side of an upper beam of a press. The plate is thus cosidered to be a thin plate which has the tendency to bend between its fastening points situated on the edges of the upper beam and which fastening points consist of the frame surrounding the circumference of the plate.

The bending causes numerous troubles essentially due to the fatigue which has been discussed in both French Patent No. 1,170,528 and in U.S. Pat. No. 3,167,992, whose disclosure is incorporated by reference and which claims priority from a Swiss patent application which was issued as Swiss Patent No. 372,546. It should be appropriate to recall that the bending will occur with the same rhythm as the press during production of cut sheets. In fact, each time the lower beam presses the sheet to be cut against the tool, the whole surface of the tool is pressed against the lower flat surface of the upper beam with the effect to cause the bending to disappear. The bending will then reappear again when the lower beam is moved out of engagement by being lowered. The same appearance will occur again with each cutting operation and at the present speed of which 10,000 sheets per hour can be processed. This means that fatigue fishers and cracks within the elements of the tool can rapidly appear.

In addition, another troublesome problem has shown up of late. Since the above mentioned act of bending brings about the formation of air pockets or strata between the tool and the upper beam or even between the various tool elements with a large flat surface for example between a makeready sheet and its protection or also between the makeready sheet and a rear metal plate as will be seen hereinafter, the volume of air contained within these pockets will be compressed and decompressed with each cutting stroke. In recently constructed high speed machines, the lower beam moves towards the upper beam and away from the upper beam with a very high acceleration and thus the decompression of air occurring during the release of the cutting pressure will end up in a severe release of condensation in the air. Thus, in countries with high rates of humidity, the condensation is likely to cause serious corrosion problems in the press.

Consequently up to now, the theoretical basic solution has consisted in trying tentatively to prevent the tool from being bent.

In order to overcome the bending, the above mentioned French Patent No. 1,170,528 proposes creating a mechanical linkage between certain points of the central part of both the tool and the upper beam. The linkage would be provided with a tightening system to allow pressing the tool against the upper beam with adequate strength. However since the slight bending might still occur between the fastening points, this solution has failed to give full satisfaction. Moreover the mechanical linkage points between the beam and the tool render the assembly and removal of the tool more difficult to a point where they would even hamper the makeready operation. In order to eliminate these drawbacks proposals have been put forth with the view of substituting for the mechanical linkage, electromagnets which are arranged within the holes made on the lower side of the upper beam. However this solution did not turn out to be more satisfactory because in addition to a high cost for the electromagnets, and the cost and inconvenience of providing all of the holes for receiving the electromagnet, the magnets have turned out to be obstructive to the makeready and would not fulfill their function correctly on account of their weak attraction caused by the magnetic saturation of the thin rear metal plate.

Another proposal according to the above mentioned U.S. Pat. No. 3,167,992 was to provide an arrangement of a network of communicating channel situated behind the tool and connected to a vacuum pump in such a way as to apply a suction between the tool and the upper beam of the platen press. The channels, which are provided on a first side of a plate with two parallel sides, are provided with holes all extending to the other parallel side. Appropriate means are foreseen for fitting the channel of the first side against the upper beam. The channels are connected to a vacuum pump however the results obtained with the ancillary fastening method making use of the vacuum achieved in the above mentioned fashion have not proven to be as expected. In fact, the suction power available between the tool and the beam is by far insufficient for the reason which will be discussed hereinafter.

SUMMARY OF THE INVENTION

The purpose of the present invention is aimed at providing an ancillary fastening method between the tool and a beam in order to eliminate the inconvenience described above. The solution to the problem is obtained by an improvement in a method for fastening a tool within a platen press which include providing a tool having a form of a plate with a front surface of which carries cutting, creasing and embossing devices, positioning this tool against a surface of an upper beam of a press, applying a vacuum between a rear surface of the tool and the lower surface of the beam in such a way as to have the tool held against the beam, said beam having an inner volume being divided up by stiffening walls into several chambers. The improvements are placing a vacuum in at least one of the chambers and connecting this chamber to a rear surface of the tool by means of at least one duct.

The improvement for the device is an improvement in a platen press design for processing sheet like material wherein a tool in the form of a plate having a front surface provided with cutting, creasing and/or embossing devices is mounted on a lower surface of an upper beam and is held against this upper surface by a vacuum built up by means for providing a vacuum between the two surfaces, and the upper beam being divided into several chambers by stiffening walls. The improvements are that the means for providing the vacuum comprises sealing at least one of the chambers to be inaccessible to ambient air and connecting this one chamber to a source of a vacuum, said one chamber being connected to a lower rear surface of the tool by at least a duct passing through a lower surface of the upper beam.

Other advantages and features of the invention will be readily apparent from the following description of the preferred embodiments, the drawing and claims.

DESCRIPTION OF THE PREFERRED EMBODIMENTS

Figure 1:
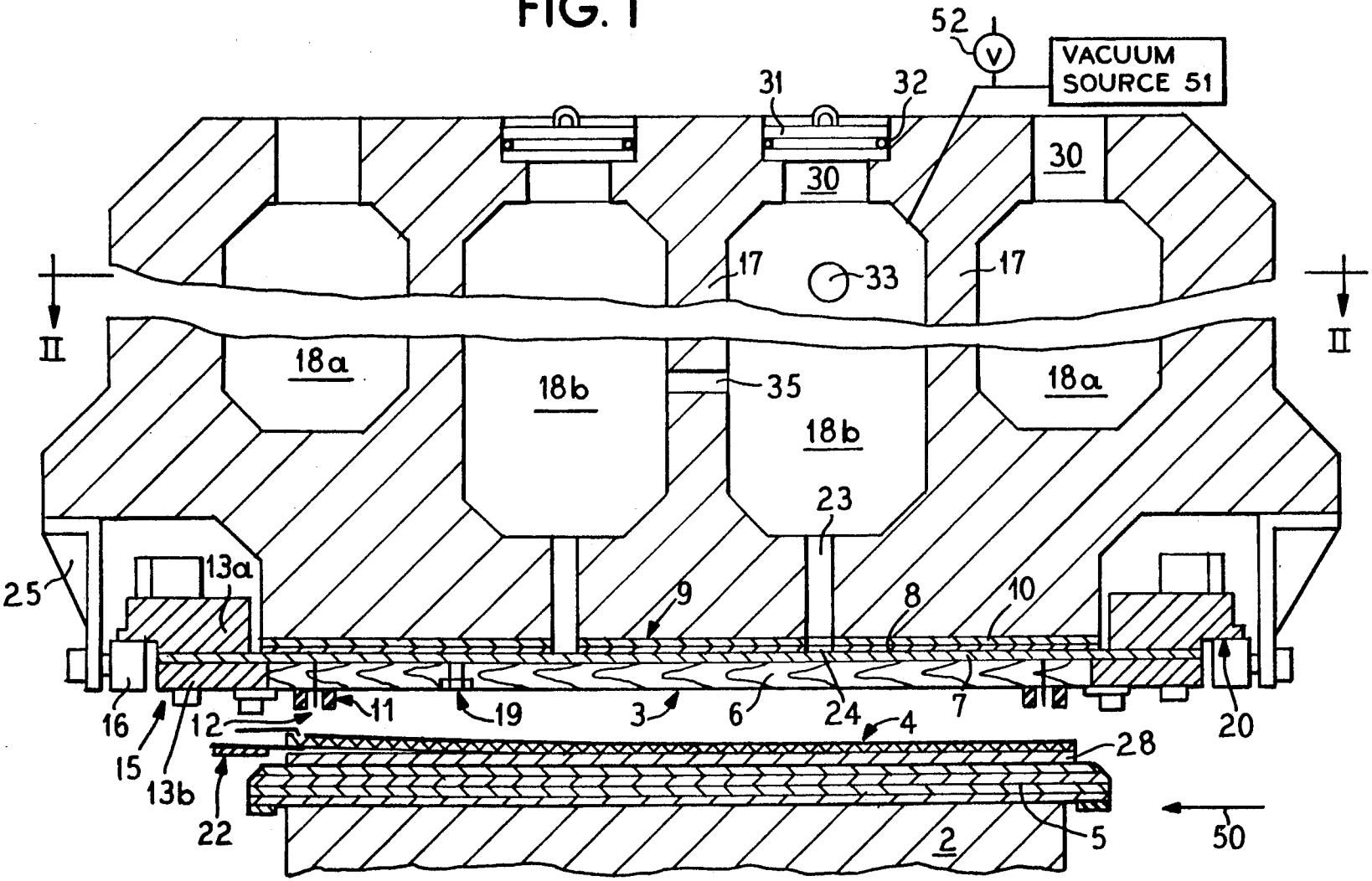
FIG. 1 is a vertical cross sectional view of a platen press having the ancillary holding arrangement in accordance with the present invention which cross sectional view extends parallel to the direction of movement of a sheet through the press.
Figure 2:
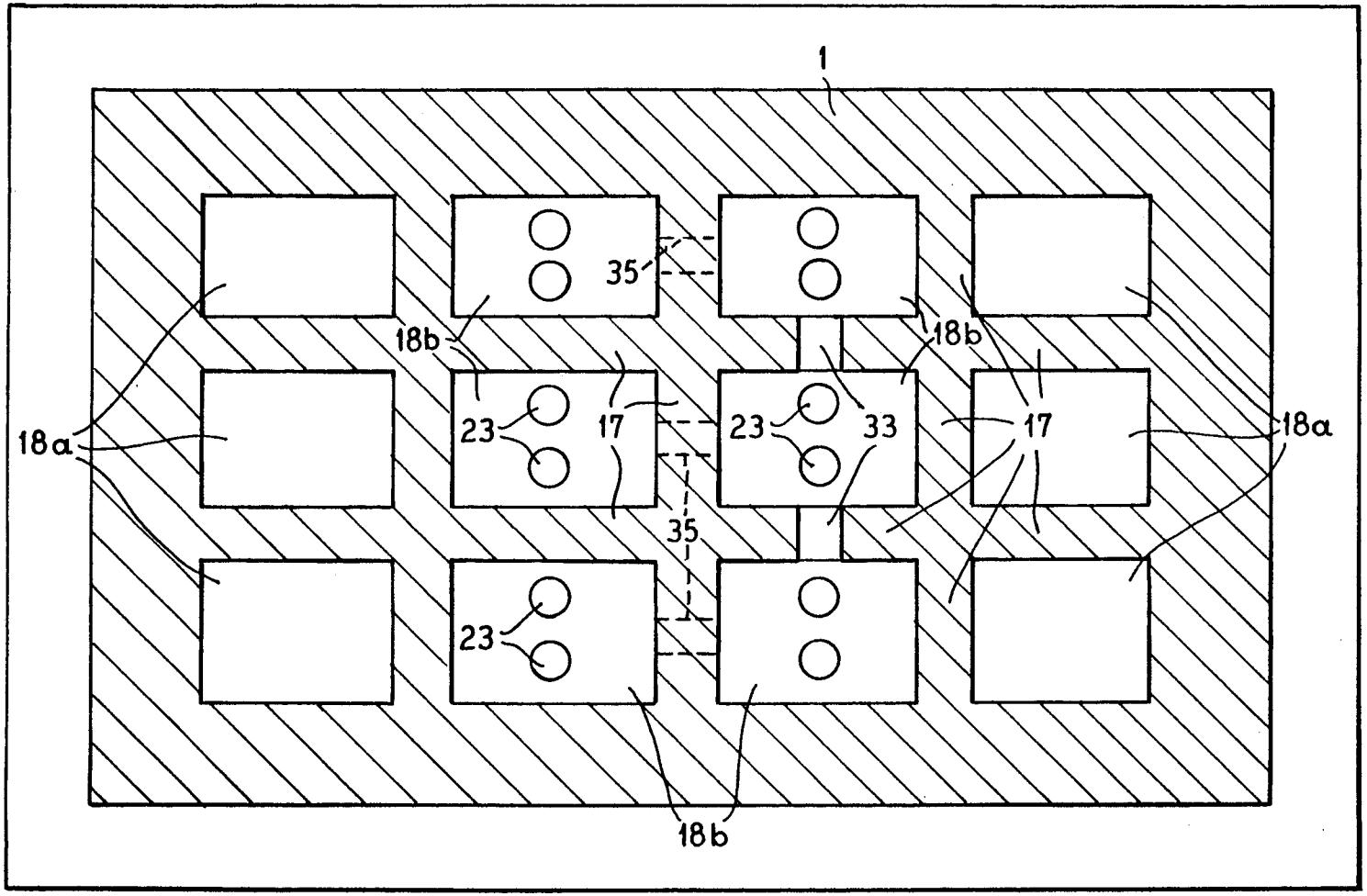
FIG. 2 is a cross sectional view taken along lines II—II of FIG. 1.

The present invention are particularly useful when incorporated in a cutting press comprising an upper platen 1 and a lower platen 2. The lower platen is formed by a lower beam which is destined to act as a support for a board or sheet 4 which is to be cut. Between the board 4 and the lower beam of the lower platen, a cutting sheet 28 and an additional plate 5 are interposed. The board 4 is carried over the cutting sheet 28 in a direction of an arrow 50 by means of a gripper assembly 22 which usually is connected to endless chains which are not illustrated. The upper platen having the upper beam 1 is provided with a cutting tool 3 which is fitted on a lower surface of the beam 1.

The cutting tool 3 includes as known in the state of the art a cutting plate or die 6 which is generally made from wood, a plastic material or the like and carries rules 12 and pressing rubber liners 11. The rules 12 may be either cutting rules as illustrated or creasing rules. The die 6 is connected to a rear metal plate 7 and the die and plate 7 are mounted in a frame generally indicated at 15 which surrounds the die 6 and consists of bars 13*a* and 13*b* between which the metal plate 7 is arranged as an intermediate layer. As illustrated the bars 13*a* have rails 20 which are situated on each longitudinal side of the frame 15 and are aligned in the direction extending perpendicular to the direction 50. The rails 20 coact with roller 16 to allow inserting the frame with the die 6 into the platen press and/or removing the frame. The roller 16 are mounted on the upper platen 1 by angle irons 25.

The die 6 is fitted against the rear metal plate 7 by means of threaded fasteners 19. A makeready sheet 8 and an additional makeready paper 10 generally consisting of short bits of paper tape and a makeready protection sheet 9 are inserted between the rear metal plate 7 and the upper beam 1. When the tool 3 is in an operating position, appropriate means, which are not represented and are linked to the frame 15, pull or push the tool 3 towards the upper beam 1. For the cutting operation the lower beam 2 is shifted upward and presses a sheet 4 in a known fashion against the cutting tool 6.

As already mentioned above, the tool 3 made up of the die 6 in the rear metal plate 7 and the frame 15 may be considered as a thin plate which in a rest position has the tendency to bend between its fastening points formed by the bars 13*a* and 13*b* themselves supported by the rails 20 on the roller 16. Conspicuously the bending of the die with a surface area of one square meter might be non-neglectible but it entails all of the inconveniences mentioned above. It is also to be pointed out that the makeready sheet 8 and the makeready protection sheet 9 will with each cutting stroke compulsory remain in full contact in the direction of the rear metal plate 7 and thus undergo a bending stress identical to the one undergone by the plate 7. In this way, even if the makeready sheet 8 and the protection sheet 9 consist as a rule of a material differing from the metal for instance of a paper or of a synthetic material, the repeated action at high speeds of the bending stresses will cause also the destruction or damage of these sheets by fatigue.

To prevent the bending which is harmful to the tool 3, the use of an ancillary fastening based on the principles of an air vacuum created between the upper beam 1 and the tool 3 provides the advantage of providing between the two elements an additional linkage not limited to only a partial area and extending its influence on the whole contact surface. In line with this concept, the problem to be resolved consists in obtaining by means of a vacuum pump of an admissible dimension a suction power that would be sufficient between the tool 3 and the upper beam 1 for completely eliminating the bending of the tool 3.

As illustrated in FIG. 1, the vertical dimensions of the upper beam 1 is very much larger than the vertical dimensions of the tool 3. For the reasons of sturdiness, the inner volume of the upper beam 1 has been subdivided by walls 17 into several chambers 18*a* and 18*b*. This sub-division is generally done to provide two rows of lateral chambers 18*a* extending along the whole length of the upper beam in a direction perpendicular to the traveling direction 50 of the board 4 to be cut and several central chamber 18*b* arranged in rows between the two rows of lateral chambers 18*a*. The bottom of each of the central chambers is provided with at least two ducts 23 which cross the upper beam 1 in such a way as to end up on a lower surface of this beam. As illustrated each of these ducts will extend as far as the upper rear surface of the metal plate 7 with the help of corresponding aligned orifices 24 which are provided on the makeready protection sheet 9 and the makeready sheet 8. The chambers 18*a* and 18*b* are as a rule provided after casting with a large-size aperture 30 which extends from each of the chambers up to an upper surface or top surface of the beam 1. In order to isolate the central chambers 18*b* from ambient air, the upper apertures 30 is machined in such a way that a tap or plug 31 provided with a seal 32 can be fitted therein. The central chambers 18*b* mentioned are communicating among themselves through cross ducts 33 and 35. All central chambers 18*b* are collectively subjected to a suction built up by a vacuum source or pump 51. This arrangement has a surprising effect that with the help of the vacuum pump 51 which is of equal dimensions as the one used in the above mentioned U.S. patent, the suction power tending to pull the tool 3 against the beam is sufficient to prevent the bending of the tool 3.

The essential reason for this incremental suction power is to be found in the influence of the large dimensions and volume exerted by each of the chambers 18*b* on the circuit of the vacuum system thus provided.

As a matter of fact with the earlier solution of the U.S. patent, the vacuum pump was connected to the rear side of the die by communicating channel of a very small dimension which channels were provided in a plate of little thickness. The dimensions of these channels were such that they no way compared to the dimensions of the communicating channels making up the chambers 18*b* of the upper beam 1 as in the case of the present invention.

It is an established fact that the compressional stresses build up between the two plates which is to say when the lower beam 2 is moved towards the tool 3 represents in the process of time a clock like curve extending approximately over $1/6^{th}$ of the cutting period or cycle. During this $1/6^{th}$ period, it is admissible to consider that the volume made up of by the central chambers 18*b*, the various ducts 33, 35 and 23 and the space contained between the lower side of the upper beam 1 and the rear plate 7 which space is almost completely filled up by the makeready protection sheet 9 and the makeready sheet 8 forms a perfectly tight medium owing to the plugs 31 with the seals 32 and to the fact that the makeready protection sheet 9 and makeready sheet 8 are all along their superimposed circumference between the rear metal plate and the upper beam 1 subjected to a compression to such a rate that any penetration of ambient air into the central chamber 18*b* will be rendered impossible. In other words during this $1/6^{th}$ of the cutting period, the vacuum which on account of various reasons would have dimensioned within the central chamber 18*b* during the remaining portion of each period is fully reestablished. Moreover after the cutting operation with the lower beam 2 lowered, the very large dimension of the chamber 18*b* brings about a very peculiar effect of conferring to these chambers the role of a vacuum reserve coming into action as soon as the tightness is no longer complete throughout the circumference of the ready-made protection sheet 9 and the ready made sheet 8. In reality it seems that this is the effect of the suction cup appearing at the level of the makeready protection sheet 9 and the makeready sheet 8 rather than the air stream proper contributing to the maintenance of the suction power. At any rate it has been noticed that the pressure release intervening in the large chambers 18*b* when under pressure at the very moment the cutting takes place and slightly released after cutting with said chambers being slightly exposed to air either at the level of the circumference of the makeready protection sheets 9 and the makeready sheet 8 or across the die 6 will easily maintain the suction power required for preventing any bending of the cutting tool 3.

For the person skill in the art, it is obvious that the ancillary fastening method of the tool 3 as described above in connection with the cutting operation can be applied in case of creasing or embossing since the platen press used for such operations differs from the cutting only by the processing devices or tools.

In conclusion, it may be said that the present invention makes an appropriate use of the large chambers already existing in the upper beam 1 of the press. The bending problem harmful to the tool is thus resolved without many modifications and practically without any additional new elements and thus with a very little cost. Moreover an interesting item to be put forth is the fact that in the event of dust resulting from the cutting, creasing or embossing operations being sucked into the chambers 18*b* of the upper beam 1, the cleaning of the later chambers would involve no difficulties and in fact accessibility is always easy through the upper aperture 30 of the chamber 18*b* since the plugs 31 with the seals 32 can be simply removed by hand as long as the chambers are not under vacuum. The seals 32 have also the purpose to prevent the plugs 31 from vibrating in their seats.

Another point to be noticed is the fact that the ancillary fastening by sucking action as described above will not interfere with the makeready operation. In fact if the duct 23 is situated exactly opposite the makeready paper 10, it might be possible to abstain from using this duct i.e. from cutting a corresponding orifice 24 into the makeready sheet 8 since there is still a sufficient number of other ducts 23 available. In this line it is revealed that it is useful to make sure that all central chambers 18*b* under vacuum are provided with at least two ducts 23 so as to be able to rely with every probability of a sufficient number of ducts. In cases where the die 6 does not cover the whole surface of the rear plate, the apertures 19 for fastening the screws situated outside of the die 6 are to be closed by means of an adhesive paper.

Similarly it is envisioned to expose the chamber 18 under vacuum to air by means of a valve such as 52 or a flap which is provided in the line to the vacuum pump or source 51. Thus by opening this valve to vent the chambers to the atmosphere to release the vacuum, it is thus easy to remove one of the plugs 31.

Finally it has been noticed that the ducts 23 add to the bottom of the central chamber 18*b* could have still another function. Appropriate measuring has shown that the air pressure curve appearing in the air pockets strata described above and situated between the rear metal plate 7 and the lower side of the upper beam 1 at the level of the makeready protection sheet 9 and the makeready sheet 8 has a configuration similar to a bell like one appearing with the cutting operation. This is to say that as the lower movable beam 2 commences its decent, the curve ceases to follow the bell like one but descends almost vertically. At this very instance will appear a severe release entailing the phenomenon referred to above i.e., the release of condensation in the air locked up within the air stratas. If this release is to be avoided, a first compulsory solution consists obviously in preventing the air from being compressed. This can be achieved within the press with the upper beam 1 in which is provided with the duct 23 and whose apertures 30 are accessible to the ambient air. Hence each time the cutting operation takes place the compressed air strata will in this case be able to escape through the ducts 23 into the central chambers 18*b* and from there be removed by the vacuum pump or source. As the air stratas are no longer compressed, the release of any condensation will no longer take place.

Although various minor modifications may be suggested by those versed in the art, it should be understood that we wish to embody within the scope of the patent granted hereon all such modifications as reasonably and properly come within the scope of our contribution to the art.

We claim as our invention:

1. In a platen press for processing sheet like material having an upper beam with a height and a lower beam movable reciprocable toward and away from said upper beam, a tool in the form of a plate having a pair of side edges, a front surface carrying processing devices and a rear surface being applied against a lower surface of the upper beam of the press, means for applying a vacuum build up between the lower surface of the upper beam and the rear surface of the plate, and said upper beam being divided into several chambers with large volumes by stiffening walls, said chambers having a height of at least half of the height of the upper beam and having a width of at least half the height of the chamber, said upper beam having depending flanges, said flanges supporting the side edges of the tool, the improvements comprising that the means for applying a vacuum comprising at least one of said chambers being isolated from ambient air and being connected to a source of vacuum, and said at least one chamber being provided with at least a duct passing through the upper beam to the lower surface of the upper beam so that the vacuum is applied directly to the rear surface of said tool.

2. In a platen press according to claim 1, wherein the inner volume of the upper beam is divided into two rows of lateral chambers and at least two rows of central chambers, said central chambers being provided with said ducts, being interconnected by cross ducts and being in communication with said source of vacuum.

3. In a platen press according to claim 2, wherein the ducts have a circular cross-section.

4. In a platen press according to claim 3, wherein at least one of the central chambers is connected to an ambient air by means of a valve.

5. In a platen press according to claim 1, wherein the duct has a circular cross-section.

6. In a platen press according to claim 1, wherein said at least one chamber acts as a vacuum reserve.

7. A platen press for processing sheet-like material having an upper beam having a lower surface and a height, said press having a lower beam reciprocated towards said upper beam, a tool having a form of a plate with a pair of side edges, a front surface carrying processing devices and a back surface of said plate being mounted on said lower surface of the upper beam of the press, an inner volume of the upper beam being divided into several chambers of large volumes by stiffening walls, each of said chambers having a height of at least half of the height of the upper beam and having a width of at least half the height of the chamber, said upper beam having depending flanges, said flanges supporting the side edges of the tool, at least one of said chambers being connected to the back surface of the tool by at least one duct passing through a lower portion of the upper beam to the lower surface and means for applying a vacuum between the lower surface and the back surface by said one chamber being in communication with a vacuum, said one chamber forming a vacuum reserve so that a vacuum is applied to hold the back surface of said plate against the lower surface of the press as said one chamber provides the vacuum reserve.

* * * * *